US005865325A

United States Patent [19]

Comstock

[11] Patent Number: 5,865,325

[45] Date of Patent: Feb. 2, 1999

[54] DISHCLOTH DRYER RACK

[76] Inventor: Douglas Comstock, 1050 Sunnyview Rd. NE., Salem, Oreg. 97303

[21] Appl. No.: 876,034

[22] Filed: Jun. 13, 1997

[51] Int. Cl.[6] ..... A47F 5/00

[52] U.S. Cl. ..... 211/181.1; 211/119.009; 211/133.5; 211/86.01; 248/206.3; 248/302

[58] Field of Search ..... 211/181.1, 106, 211/119.002, 119.009, 86.01, 41.14, 85.31, 133.5, 133.6, 119.008; 248/302, 206.2, 206.3

[56] References Cited

U.S. PATENT DOCUMENTS

| | | | |
|---|---|---|---|
| 1,580,847 | 4/1926 | Moineau | 248/302 |
| 1,734,532 | 11/1929 | Sacerdote | 211/119.008 |
| 1,957,353 | 5/1934 | Piersall | 248/302 X |
| 3,269,555 | 8/1966 | Henderson | 211/86.01 |
| 5,158,009 | 10/1992 | Stewart | 211/181.1 X |
| 5,217,123 | 6/1993 | Riley et al. | 248/206.3 X |
| 5,232,189 | 8/1993 | Koch | 248/302 X |

*Primary Examiner*—Robert W. Gibson, Jr.

[57] ABSTRACT

A dish cloth dryer rack includes a wire-like frame having a dish-cloth drying portion thereof, which drying portion is curved to fit over a sink divider. The rack is held in place by feet which support the rack above the level of the sink divider, thereby providing a free air space between the rack and the sink divider. A tool-carrying basket may be integrally formed with the elongate portion to provide storage for soap and additional cleaning tools.

9 Claims, 2 Drawing Sheets

DISHCLOTH DRYER RACK

FIELD OF THE INVENTION

The invention relates to a device that mounts on the divider of a kitchen sink which aids in the storage and drying of dishcloths and other sink related tools and or soap bars.

BACKGROUND AND SUMMARY OF THE INVENTION

We live in a time where the elimination of bacteria is not only desirable, but essential. To help eliminate bacteria from the kitchen sink, all tools used in the sink must dry as soon as possible. Moisture trapped in the tools i.e. dishcloth, dish brushes, will promote the growth of bacteria almost immediately, then spread bacteria when used.

While researching prior art, I discovered that Douglas J. Koch, U.S. Pat. No. 5,232,189, and Marion A. Riley & Robert Hesdorfer, U.S. Pat. No. 5,217,123, have all developed drying devices, however, neither device prevents a dishcloth from making contact with the sink itself. Both of the referenced patents depend solely on suction cups to position their devices in place. The suggested positioning of the devices is awkward, does not allow for maximum ease of use, and is not versatile.

North, U.S. Pat. No. 363,627, resembles two saddle bags straddling the center divider of a kitchen sink. This design is very bulky and will take up valuable space in the sink. This device does not allow enough air to pass through a dishcloth, thereby aiding in the growth of mold and bacteria.

Odbert, U.S. Pat. No. 354,873, is a soap holder, and will not accommodate a washcloth, sponge, or any sink tools.

SUMMARY OF THE INVENTION

The dryer rack of the invention includes a wire-like frame having a dish-cloth drying portion thereof, which elongate portion is curved to fit over a sink divider. The rack is held in place by fasteners which support the rack above the level of the sink divider, thereby providing a free air space between the rack and the sink divider. A tool-carrying basket may be integrally formed with the elongate portion to provide storage for soap and additional cleaning tools.

Accordingly, several objects and advantages of the dryer rack of the invention are:

(a) easy to install;

(b) dishwasher safe;

(c) reusable;

(d) many designer colors;

(e) does not retain water so the soap bar will not soften and dissolve;

(f) allows air to circulate freely in and around dishcloth and sink tools;

(g) it will aid in the drying of dishcloths, soap, and other sink related tools;

(h) helps in the prevention of bacteria growth;

(i) helps prevent dishcloth odor;

(j) inexpensive to produce therefore inexpensive to buy at the retail level.

It is an object of the dryer rack of the invention to allow multiple dishcloths, sponges, soap, or any form of sink tool to dry in a quick and orderly fashion.

A further object of the invention is to provide a dryer rack that is inexpensive to produce and package.

Still further objects and advantages of will become apparent from a consideration of the ensuing description and drawings.

DETAILED DESCRIPTION OF THE PREFERRED EMBODIMENTS

Figure 1:
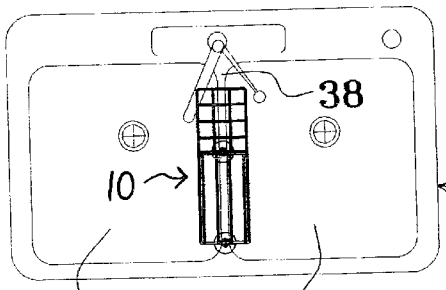
FIG. 1 depicts the dryer rack of the invention in an environmental setting.
Figure 2:
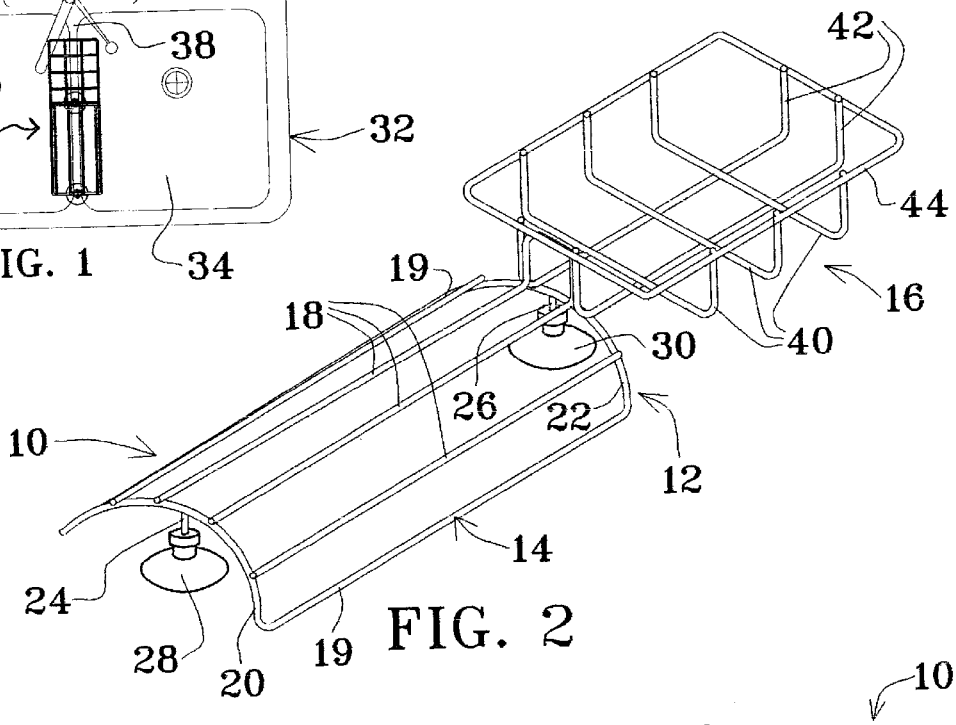
FIG. 2 is a perspective view of the dryer rack of the invention.
Figure 3:
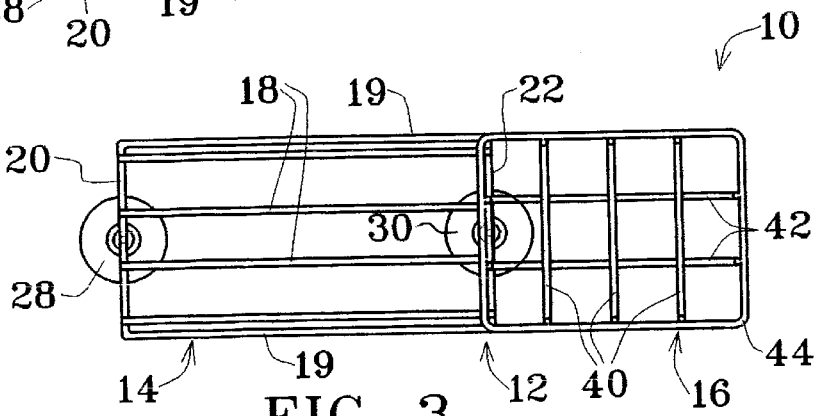
FIG. 3 is a top plan view of the dryer rack.
Figure 5:
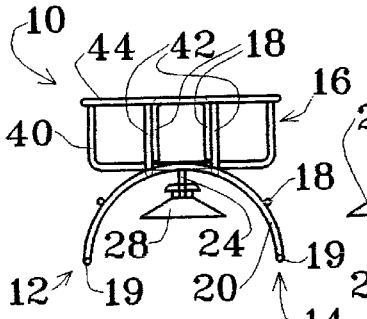
FIG. 5 is an end view of the dryer rack.
Figure 4:
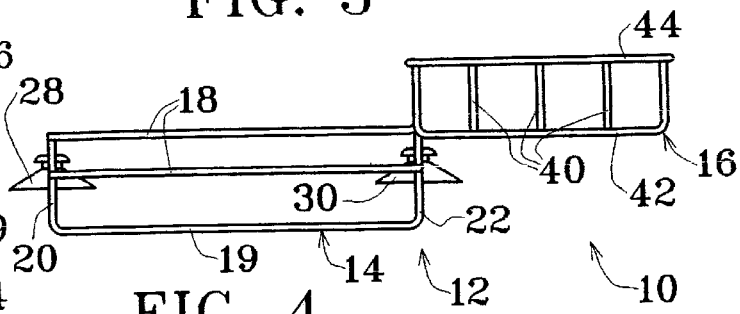
FIG. 4 is a side elevation of the dryer rack.

Turning initially to the first embodiment of the invention, and with reference to FIGS. 1–5, a dish cloth dryer rack constructed according to the invention is depicted generally at 10. Rack 10 includes a wire-like frame 12, which has an elongate, dish-cloth drying portion 14 and a tool-carrying basket portion 16. Drying portion 14 includes plural, elongate, internal wire-like structures 18, and a pair of spaced-apart, lateral wire-like structures 19, all of which extend between curved ends 20, 22. Legs 24, 26 extend downward from ends 20, 22, respectively, and are tipped, in the preferred embodiment, with suction cups, 28, 30, respectively. Suction cups 28, 30 are also referred to herein as foot structures. As rack 10 will be held in place by its curved shape and gravity, suction cups 28, 30 may be replaced with some other form of foot, so long as the selected structure protects the finish on sink 32.

Referring now to FIG. 1, rack 10 is depicted in an environmental setting on sink 32, which includes a pair of basins 34, 36, and a divider 38 located between basins 34, 36. Rack 10 is designed to fit over divider 38 and to stand-off therefrom, so as to provided free-air circulation about the implements placed on rack 10.

Drying portion 14, in the preferred embodiment, has six elongate wire-like structures, 2.3 mm in diameter each, running parallel and arcing in a semi circle creating an inverted trough. The six parallel wires of drying portion 14 have, in the preferred embodiment, a length of 20.3 cm. Ends 20, 22 have a flat length of 10.2 cm. In the preferred embodiment, rack 10 is constructed of vinyl-coated wire, however, as will be appreciated by those of skill in the art, the wire-like structures of the frame and basket may be formed of solid or hollow plastomer material, or from a rust proof, un-coated metal. Wire-like structures 19 and ends 20, 22 may be formed of a single length of appropriately formed and joined material, having wire-like structures 18 fastened thereto.

In this embodiment of the invention, basket 16 is attached to dryer portion 14. Basket 16 is formed from the same material as dryer portion 14 and may be integrally formed therewith. Basket 16 includes wire-like structures 40, 42, which make up the base of basket 16, and a rim 44, which extends about the open, upper margin of basket 14. As is shown in the drawings, one way of forming basket 16 with dryer portion 14 is to extend the ends of wire-like structures 18 upward so as to join with basket wire-like structures 42, or to replace a small portion of wire-like structure 42. In the preferred embodiment, basket 16 is 12.7 cm long, 8.9 cm wide and 3.2 cm high. Wires 40, 42 and 44 are 2.3 mm in diameter. These wire-like structures are evenly spaced in basket 16.

The manner of using dryer rack 10 should now be evident. Suction cups 28, 30 are attached to sink divider 38 to support dryer rack 10 in a spaced-apart relationship with sink divider 38. A dishcloth may be laid over dryer portion 14, and soap or sink tool(s) may be placed in basket 14. Legs 24, 26 cause drying portion 14 to stand away from divider 38, which provides a free-air space between rack 10 and divider 38. Because of the air flow in and around the dishcloth, soap bar and sink tools, they will dry quicker and help prevent bacteria growth.

Figure 6:
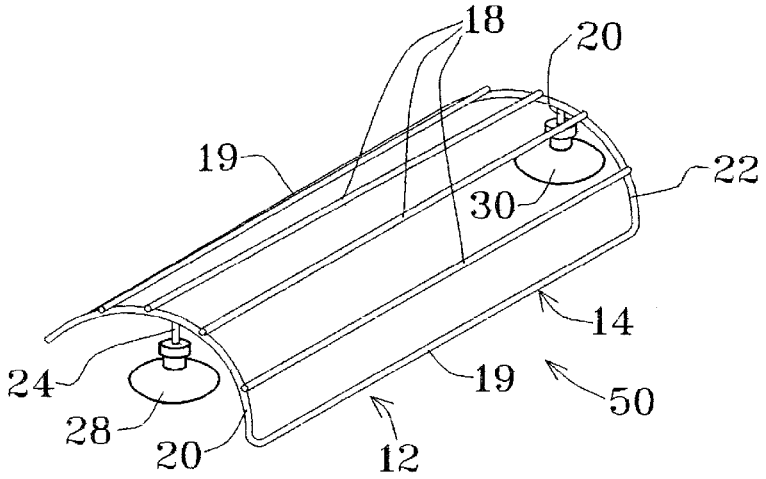
FIG. 6 depicts a second embodiment of the dryer rack of the invention.
Figure 7:
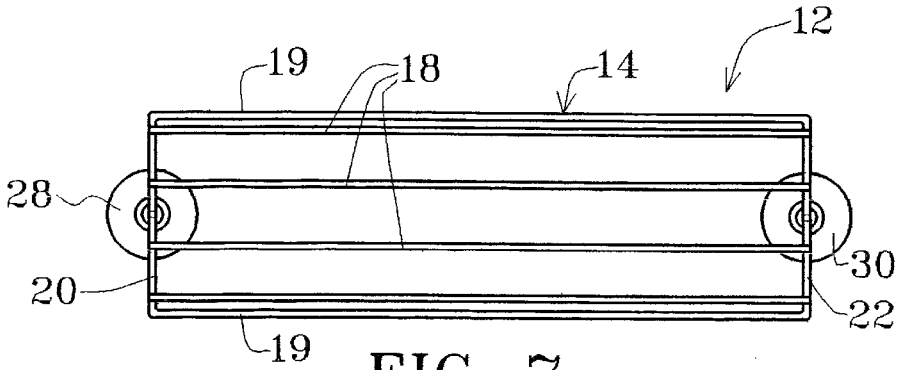
FIG. 7 is a top plan view of the dryer rack of FIG. 6.
Figure 9:
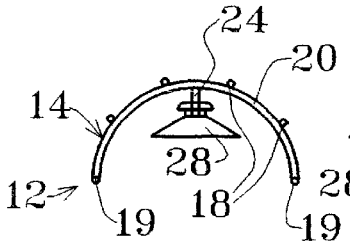
FIG. 9 is an end view of the dryer rack of FIG. 6.
Figure 8:
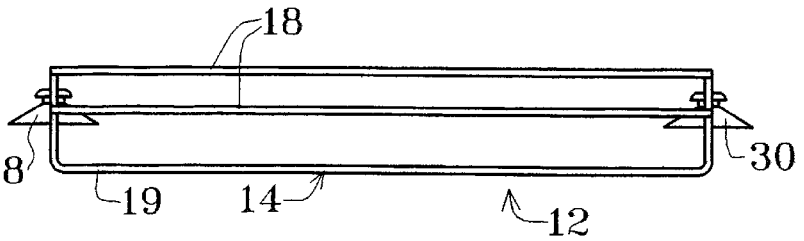
FIG. 8 is a side elevation of the dryer rack of FIG. 6.

Turning now to FIG. 6, a perspective view of a second embodiment of the drying rack is shown generally at 50. Rack 50 is constructed similarly to dryer portion 14 of rack 10, and shares its dimensions and construction parameters. Where like structures are common between rack 10 and rack 50, like reference numerals are used.

Thus, a drying rack has been disclosed which is not only desirable as a kitchen aid, but will help in the prevention of odor and bacterial growth.

Further variations and modifications may be made to the dryer rack of the invention. For example, the dryer rack may be constructed in a variety of models, having different sizes of dryer portions and baskets. It may be constructed not only of vinyl-coated wire, but from solid injected plastics, nylon, or formed from stainless steel wire. The dryer rack may come in a variety of designer colors to match any decor, or may have a brushed metal appearance. The dryer rack may also be constructed so as to allow removal of basket 16 from dryer portion 14, and reassembly of a dryer portion and basket in coordination/contrasting colors. The dryer rack is a versatile, yet compact sink organizer, and is constructed and arranged to fit most sinks. The dryer rack's main function is to expedite the drying time of the dishcloth, soap, and sink tools. This will help to prevent the spread of bacteria and the deterioration of the bar soap.

Although a preferred embodiment of the dryer rack of the invention, and a variation thereof, have been disclosed, it should be appreciated that further variations and modifications may be made thereto, while remaining within the scope of the claims appended hereto.

I claim:

1. A dishcloth dryer rack for mounting on a sink comprising:

an elongate, open-structure frame for providing free-air circulation about implements placed on the rack, including:

a dish-cloth drying portion having curved ends thereto and elongate, wire-like structures extending between said curved ends; and a tool-carrying basket attached to said dish-cloth drying portion and supported thereby;

a pair of spaced-apart legs, each of said legs depending downward from the center of said curved end for providing a space between the rack and the sink on which it is mounted; and a foot structure located at the free end of each leg for supporting the rack on the sink.

2. The dryer rack of claim 1 wherein said foot structure is a suction cup.

3. The dryer rack of claim 1 wherein said drying portion and said basket are integrally formed.

4. The dryer rack of claim 1 wherein at least some of said elongate, wire-like structures from said drying portion extend into said basket.

5. A dishcloth dryer rack for mounting on a sink comprising:

an elongate, open-structure frame for providing free-air circulation about implements placed on the rack, including:

a dish-cloth drying portion having curved ends thereto and elongate, wire-like structures extending between said curved ends; and a tool-carrying basket attached to said dish-cloth drying portion and supported thereby, wherein at least some of said elongate, wire-like structures from said drying portion extend into said basket;

a pair of spaced-apart legs, each of said legs depending downward from the center of said curved end for providing a space between the rack and the sink on which it is mounted; and a foot structure located at the free end of each leg for supporting the rack on the sink.

6. The dryer rack of claim 5 wherein said foot structure is a suction cup.

7. The dryer rack of claim 6 wherein said drying portion and said basket are integrally formed.

8. A dishcloth dryer rack for mounting on a sink comprising:

an elongate, open-structure frame for providing free-air circulation about implements placed on the rack, including:

a dish-cloth drying portion having curved ends thereto and elongate, wire-like structures extending between said curved ends; and a pair of spaced-apart legs, each of said legs depending downward from the center of said curved end for providing a space between the rack and the sink on which it is mounted; and a foot structure located at the free end of each leg for supporting the rack on the sink.

9. The dryer rack of claim 8 wherein said foot structure is a suction cup.

* * * * *

UNITED STATES PATENT AND TRADEMARK OFFICE

CERTIFICATE OF CORRECTION

PATENT NO. : 5,865,325

DATED : 2-2-99

INVENTOR(S) : Douglas Comstock

It is certified that error appears in the above-identified patent and that said Letters Patent is hereby corrected as shown below:

On the title page, item [76], should read

Inventor: Douglas Comstock, 1880 Beach Ave. N.E., Salem, Oregon 97303

Signed and Sealed this

Eighteenth Day of May, 1999

*Attest:*

Q. TODD DICKINSON

*Attesting Officer*

*Acting Commissioner of Patents and Trademarks*